US007662025B2

(12) United States Patent
Saito

(10) Patent No.: US 7,662,025 B2
(45) Date of Patent: Feb. 16, 2010

(54) POLISHING APPARATUS INCLUDING SEPARATE RETAINER RINGS

(75) Inventor: Toshiya Saito, Tokyo (JP)

(73) Assignee: Elpida Memory, Inc., Chuo-ku, Tokyo (JP)

( * ) Notice: Subject to any disclaimer, the term of this patent is extended or adjusted under 35 U.S.C. 154(b) by 0 days.

(21) Appl. No.: 12/010,109

(22) Filed: Jan. 22, 2008

(65) Prior Publication Data

US 2008/0176486 A1 Jul. 24, 2008

(30) Foreign Application Priority Data

Jan. 22, 2007 (JP) ..... 2007-011157

(51) Int. Cl.
*B24B 49/00* (2006.01)

(52) U.S. Cl. ..... 451/11; 451/41; 451/287; 451/288; 451/398

(58) Field of Classification Search ..... 451/10, 451/11, 41, 63, 285, 287, 288, 397, 398, 451/402

See application file for complete search history.

(56) References Cited

U.S. PATENT DOCUMENTS

| | | | | |
|---|---|---|---|---|
| 6,224,712 | B1 * | 5/2001 | Ueno | 156/345.14 |
| 6,821,192 | B1 * | 11/2004 | Donohue | 451/285 |
| 6,964,597 | B2 * | 11/2005 | Khuu | 451/5 |
| 6,976,908 | B2 * | 12/2005 | Masunaga et al. | 451/288 |
| 7,056,196 | B2 * | 6/2006 | Numoto | 451/285 |
| 2004/0018806 | A1 * | 1/2004 | Numoto | 451/285 |
| 2004/0142646 | A1 * | 7/2004 | Chen et al. | 451/288 |
| 2004/0171331 | A1 * | 9/2004 | Maloney et al. | 451/41 |
| 2005/0124269 | A1 * | 6/2005 | Masunaga et al. | 451/285 |
| 2006/0099893 | A1 * | 5/2006 | Masunaga et al. | 451/287 |
| 2007/0270089 | A1 * | 11/2007 | Saito | 451/285 |

FOREIGN PATENT DOCUMENTS

| | | |
|---|---|---|
| JP | 2000-061824 | 2/2000 |
| JP | 2002-270551 | 9/2002 |
| JP | 2002-367941 | 12/2002 |
| JP | 2004-119495 | 4/2004 |
| JP | 2004-209613 | 7/2004 |
| JP | 2004-327547 | 11/2004 |
| JP | 2007-307623 | 11/2007 |

OTHER PUBLICATIONS

Japanese Office Action dated Feb. 19, 2009 with Partial English Translation.
Japanese Office Action dated Sep. 29, 2008 with Partial English Translation.
Japanese Office Action dated Aug. 3, 2009 with Partial English Translation.

* cited by examiner

*Primary Examiner*—Eileen P. Morgan
(74) *Attorney, Agent, or Firm*—McGinn IP Law Group, PLLC

(57) ABSTRACT

A polishing apparatus includes a polishing pad for polishing a wafer and a polishing head for holding the wafer. The polishing head includes a retainer ring, a membrane sheet, and a head body. The retainer ring retains the wafer in a horizontal direction. The membrane sheet depresses the wafer to the polishing pad. The head body supports the retainer ring and the membrane sheet. The retainer ring includes a fixed retainer ring and a released retainer ring. The released retainer ring is interposed between the inner periphery of the fixed retainer ring and the periphery of the wafer to retain the wafer in the horizontal direction.

20 Claims, 4 Drawing Sheets

POLISHING APPARATUS INCLUDING SEPARATE RETAINER RINGS

This application is based upon and claims the benefit of priority from Japanese patent application No. 2007-011157, the disclosure of which is incorporated herein in its entirety by reference.

BACKGROUND OF THE INVENTION

1. Field of the Invention

The present invention relates to a polishing apparatus. More particularly, the invention relates to a polishing apparatus that is suitable for use in the chemical mechanical polishing (CMP) process performed in manufacturing semiconductor devices.

2. Description of the Related Art

In recent years, the integration density of semiconductor devices has increased, making it possible to form a multilayer interconnection structure in each semiconductor device. To manufacture a semiconductor device having the multilayer interconnection structure, each layer of the multilayer interconnections should have so flat a surface that projections and depressions, if any, may fall within the focal depth of the light source used in photolithography. The CMP process is employed to impart such a flat surface to the each film.

FIG. 5 shows a polishing apparatus 100 designed for use in the CMP process. The polishing apparatus 100 includes a polishing pad 11 that has a circular polishing surface 11*a*. On the polishing surface 11*a*, a wafer 12 is mounted, and a polishing head 13 is positioned thereon to sandwich the wafer 12 between the same and the polishing surface 11*a*. The polishing head 13 includes a head body 14, a retainer ring 16, and a membrane sheet 17. The head body 14 is of a disc shape The membrane sheet 17 has a diameter substantially equal to the diameter of the wafer 12, contacts the rear surface of the wafer 12, and is disposed below the head body 14. The retainer ring 16 is disposed to surround the wafer 12 and the membrane sheet 17. The bottom of the head body 14 and the membrane sheet 17 define a closed space 18. High-pressure air is supplied into the closed space 18, whereby the wafer 12 is depressed toward the polishing pad 11.

The retainer ring 16 has a top surface secured to the bottom of the head body 14 and a bottom surface in contact with the polishing surface 11*a* of the polishing pad 11. FIG. 6 is a top plan view illustrating the positional relationship between the wafer 12 and the retainer ring 16. The retainer ring 16 contacts, at the inner periphery thereof, the periphery of the wafer 12 to retain the wafer 12 in a horizontal direction, i.e., in-plane direction of the wafer 12.

During polishing the wafer 12, the polishing pad 11 is rotated around the axis thereof, while slurry, i.e., polishing agent, is being supplied onto the center of the polishing surface 11*a*. The membrane sheet 17 depresses the rear surface of the wafer 12 retained within the retainer ring 16. The main surface of the wafer 12 is thereby depressed onto the polishing surface 11*a*. In this condition, the polishing head 13 is rotated around the axis thereof and moved back and forth in the radial direction of the polishing surface 11*a*, whereby the polishing head 13 polishes the main surface of the wafer 12 in the CMP process.

JP 2004-119495A and JP 2002-367941A, for example, describe apparatus similar to the polishing apparatus of FIG. 5 and a polishing method such as described above.

In the conventional polishing apparatus 100, the periphery of the membrane sheet 17 is aligned with the periphery of the wafer 12 as shown in FIG. 5. However, the membrane sheet 17 is deformed to bulge downwards, when high-pressure air is supplied into the closed space 18 to conduct the polishing. As a result, the periphery of the membrane sheet 17 is raised as is indicated by numeral 31 in FIG. 7. Inevitably, the pressure depressing the wafer 12 downwards will be decreased in the vicinity of the periphery of the wafer 12.

The decrease in the pressure depressing the wafer 12 downwards reduces the polishing rate during the CMP process to cause a non-uniform surface, i.e., a lager range of variation on the polished surface. This ultimately lowers the product yield in the manufacture of semiconductor devices. To solve this problem, the assigner of the present invention has a proposal as described in JP Patent Application No. 2006-136024 that the membrane sheet 17 should have a larger diameter than the wafer 12 so that the periphery of the membrane sheet 17 may not be raised and may not be brought into contact with the wafer 12 during the polishing process.

SUMMARY OF THE INVENTION

An object of the present invention is to provide a polishing apparatus that can suppress the decrease in the depressing force that depresses the peripheral portion of the wafer to be polished, to thereby maintain the polishing rate and to prevent occurrence of a non-uniform polished surface in the CMP process.

The present invention provides a polishing apparatus including: a polishing pad configured to polish a wafer; and a polishing head configured to hold the wafer and the polishing head, the polishing head including a retainer ring for retaining the wafer in an in-plane direction of the wafer, a membrane sheet for depressing the wafer toward the polishing pad, and a head body supporting thereon the retainer ring and the membrane sheet, wherein: the retainer ring includes a first member having a substantially ring shape, has inner diameter and thickness larger than outside diameter and thickness, respectively, of the wafer, and is depressed toward the polishing pad by the head body, and a second member having a thickness substantially equal to the thickness of the wafer, is interposed between an inner edge of the first member and a periphery of the wafer to retain the periphery of the wafer in the in-plane direction of the wafer; and the membrane sheet depresses the wafer and the second member toward the polishing pad.

The above and other objects, features and advantages of the present invention will be more apparent from the following description, referring to the accompanying drawings.

DETAILED DESCRIPTION OF THE EMBODIMENTS

Figure 1:
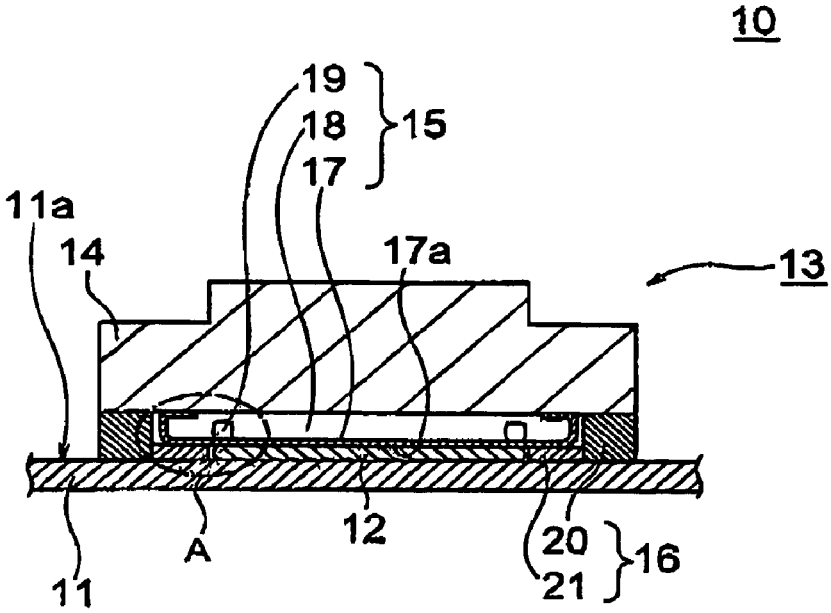
FIG. 1 is a sectional view showing a polishing apparatus according to an embodiment of the present invention.

An exemplarily embodiment of the present invention will be described in detail hereinafter, with reference to the accompanying drawings, wherein similar constituent elements are designated by similar reference numerals throughout the drawings. FIG. 1 is a sectional view showing a polishing apparatus 10 according to the embodiment of the present invention. The polishing apparatus 10 is designed for use in the CMP process performed on oxide films during the manufacture of semiconductor devices. The polishing apparatus 10 includes a polishing pad 11 that has a circular polishing surface 11*a* and can rotate around the axis thereof. The polishing pad 11 is made of polyurethane and has polishing grooves formed on the polishing surface 11*a* for obtaining an efficient polishing surface.

Above the polishing surface 11*a* of the polishing pad 11, a slurry supply tube (not shown) is supported, with a slurry port thereof being aligned with the center of the polishing surface 11*a*. A wafer 12 is mounted on the polishing surface 11*a* of the polishing pad 11. A polishing head 13 is arranged above the wafer 12 to oppose the wafer 12. The polishing head 13 includes a head body 14, a depressing unit 15, and a retainer ring 16. The head body 14 is substantially of a disc shape. The depressing unit 15 is positioned at the central part of the bottom surface of the head body 14 to thereby depress the wafer 12 toward the polishing pad 11. The retainer ring 16 is so arranged to surround the wafer 12 and the depressing unit 15, and to retain the wafer 12 in the horizontal direction. The head body 14 is made of, for example, metal or alloy.

The depressing unit 15 includes a membrane sheet 17 provided on the central part of the bottom surface of the head body 14. The membrane sheet 17 has a U-shaped vertical cross section. The membrane sheet 17 is secured, at the top edge thereof, to the bottom of the head body 14, whereby the membrane sheet 17 and the bottom of the head body 14 define a closed space 18. The closed space 18 is communicated with a first air supply unit that can supply high-pressure air. The high-pressure air may be supplied into the closed space 18 to adjust the pressure in the closed space 18. When the pressure is thus adjusted, the pressure applied to the rear surface of the wafer 12, depressing the wafer 12 downwards, can be adjusted. The bottom of the membrane sheet 17 configures a flat depressing surface 17*a* that is substantially of a circular shape. In the present embodiment, the depressing surface 17*a* is larger than the wafer 12. Hence, the periphery of the depressing surface 17*a* is disposed outside the periphery of the wafer 12. The membrane sheet 17 is, for example, Neoplane (trademark).

In the closed space 18, an edge-depressing member 19 is disposed on the membrane sheet 17 and extends along the periphery of the wafer 12. The edge-depressing member 19 is a tubular ring, the internal of which is communicated with a second air supply unit that can supply high-pressure air. The edge-depressing member 19 can adjust the pressure of the air, to thereby adjust the pressure that depresses downwards the periphery of the wafer 12. Hence, two pressures are exerted on the periphery of the wafer 12 from the first air supply unit and the second air supply unit.

The retainer ring 16 includes a fixed retainer ring 20 and a released retainer ring 21. The fixed retainer ring 20 contacts with, at the top surface thereof, the bottom of the head body 14, and at the bottom surface thereof, the polishing surface 11*a* of the polishing pad 11. The released retainer ring 21 is disposed inside the fixed retainer ring 20, and provided as a separate member separated from the fixed retainer ring 20. The released retainer ring 21 has a thickness substantially equal to that of the wafer 12 and is interposed between the polishing surface 11*a* and the depressing surface 17*a* of the membrane sheet 17. The released retainer ring 21 contacts with, at the outer periphery thereof, the inner periphery of the fixed retainer ring 20, and also contacts with, at the inner periphery thereof, the periphery of the wafer 12. Thus, the released retainer ring 21 retains the wafer 12 in the horizontal direction.

Figure 2A:
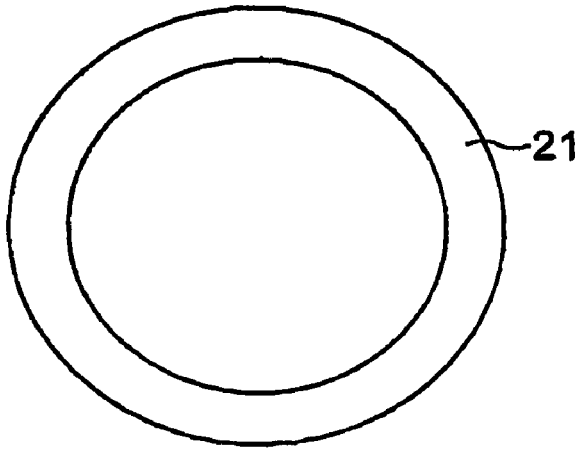
FIGS. 2A and 2B are a top plan view and a sectional view, respectively, of the retainer ring provided in the polishing apparatus of FIG. 1.
Figure 2B:
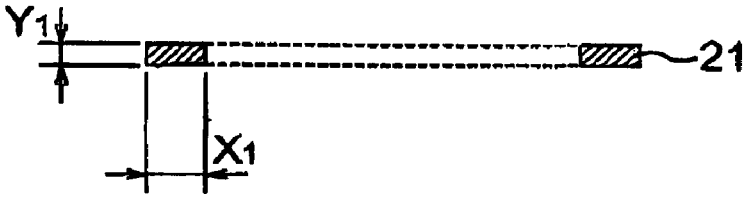
Figure 3:
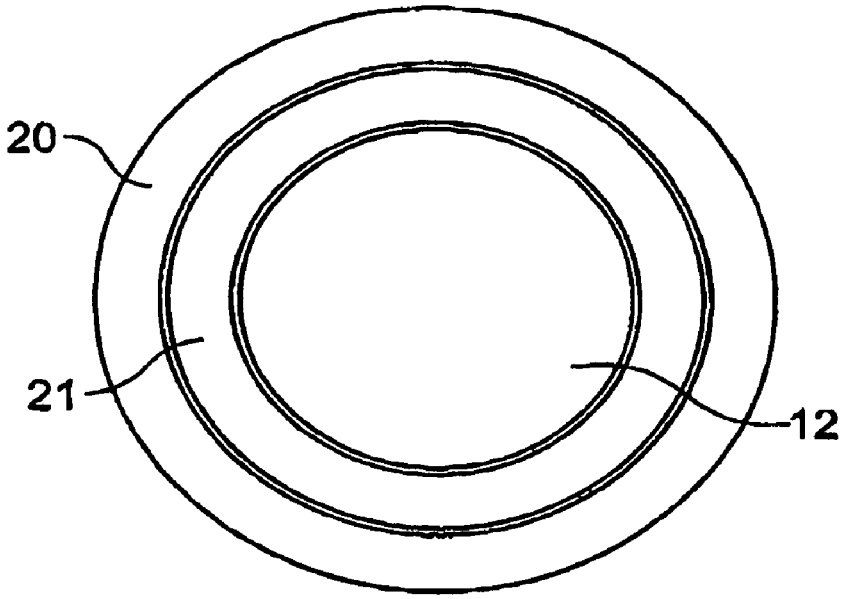
FIG. 3 is a top plan view illustrating the positional relationship that the fixed retainer ring, the released retainer ring and the wafer have in the polishing apparatus of FIG. 1.

FIGS. 2A and 2B are a top plan view and a sectional view, respectively, of the released retainer ring 21, depicting the shape of the released retainer ring 21. FIG. 3 is a top plan view illustrating the positional relationship that the fixed retainer ring 20, released retainer ring 21 and wafer 12 have therebetween. The thickness Y1 of the released retainer ring 21 as shown in FIG. 2B is substantially equal to the thickness of the wafer 12, and is 0.775 mm in this example. The released retainer ring 21 has a width X1 of 20 mm. The fixed retainer ring 20 and the released retainer ring 21 are made of, for example, poly-phenylene sulfide (PPS) or poly-ether-ether-ketone (PEEK).

Figure 4:
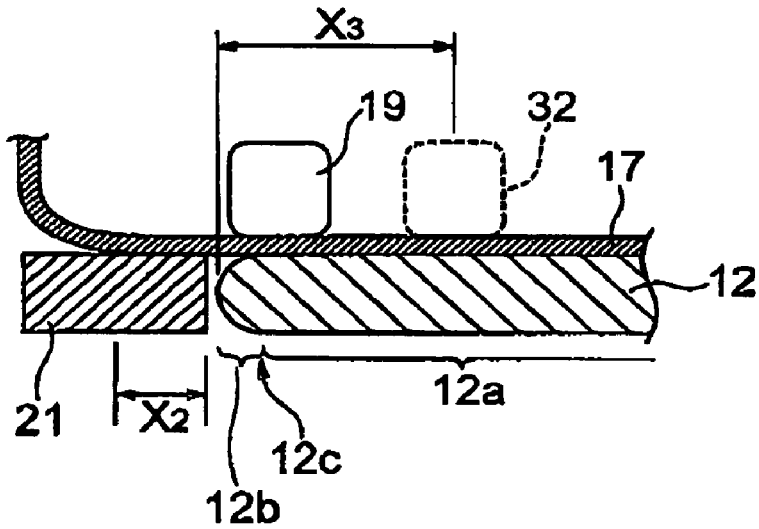
FIG. 4 is a magnified sectional view of the portion encircled by a chain line A in FIG. 1.

FIG. 4 is a magnified sectional view of the portion encircled by a chain line A in FIG. 1. As shown in FIG. 4, the edge-depressing member 19 is arranged at the boundary 12*c* between the flat part 12*a* and the edge part 12*b* of the wafer 12. In the conventional polishing apparatus 100, the periphery of the membrane sheet 17 is aligned with the periphery of the wafer 12. Therefore, the edge-depressing member 19, if used, cannot be positioned near the periphery of the wafer 12, as is indicated by numeral 32 in FIG. 4. Consequently, the periphery of the wafer 12 cannot be efficiently depressed in the conventional polishing apparatus 100. In the polishing apparatus 10 according to the present invention, the periphery of the wafer 12 can be effectively depressed, because the periphery of the membrane sheet 17 is disposed outside the periphery of the wafer 12 and the edge-depressing member 19 is positioned in the vicinity of the periphery of the wafer 12.

The operation of the polishing apparatus 10 during polishing of the wafer 12 will be described with reference to FIG. 1 again. The polishing pad 11 is rotated around the axis of the polishing surface 11*a*, at a rotational speed of 30 $min^{-1}$, while silica-based slurry is being supplied onto the center of the polishing surface 11*a* at a rate of 300 ml(milliliter)/min. The rotation of the polishing pad 11 in this way spreads the slurry over the polishing surface 11*a* in the radial direction from the center of the polishing surface 11*a*, finally covering all the polishing surface 11*a*. The wafer 12 is attracted by suction in a facedown posture toward the bottom of the polishing head 13 and then moved downwards to the polishing pad 11.

The wafer 12 is retained in the released retainer ring 21. The head body 14 is mechanically depressed with load F1 onto the polishing pad 11. Further, the first air supply unit is driven to apply load F2, which is smaller than load F1, onto the wafer 12 and the top surface of the released retainer ring 21. As a result, the membrane sheet 17 is depressed toward the entire surface of the wafer 12 and toward that part of the released retainer ring 21, which extends for distance X2 (=5 mm) from the inner periphery of the ring 21, as illustrated in FIG. 4.

Moreover, the edge-depressing member 19 exerts load F3 onto the vicinity of the periphery of the wafer 12, adjusting the force depressing downwards the vicinity of the periphery of the wafer 12. Load F1 and load F2 are set to, for example, 70 N (Newton) and 50 N, respectively. Load F3 is set to, for example, 45 to 55 N, thereby eliminating the non-uniform pressure distribution in the vicinity of the periphery of the wafer 12, which has resulted from the application of force F2. That is, the pressure applied onto the depressing surface 17*a* is rendered uniform. The membrane sheet 17 is thereby depressed onto almost the entire surface of the released retainer ring 21.

The polishing head 13, which holds the wafer 12 in the above state, is rotated around the axis thereof at a rotational speed of 29 $min^{-1}$ and is moved back and forth in the radial direction of the polishing pad 11 for a distance within the radius of the polishing pad 11. A CMP process is thereby conducted on the main surface of the wafer 12. After the wafer 12 is subjected to the CMP process for a prescribed time length, the wafer 12 is transported from the polishing apparatus 10 to a washing apparatus associated with the polishing apparatus 10. The wafer 12 is washed, and then collected from the washing apparatus. Meanwhile, another wafer 12 is mounted on the polishing apparatus 10 and is polished similarly to the process as specified above. While the wafer 12 is being polished, the wafer 12 is retained substantially integrally with the released retainer ring 21, because the depressing surface 17*a* depresses the top surface of the wafer 12 and released retainer ring 21 with a uniformly distributed force.

In the present embodiment, the periphery of the membrane sheet 17 is positioned outside the periphery of the wafer 12. Hence, the periphery of the membrane sheet 17, which may be raised during the polishing process, will not contacts the wafer 12. This prevents a decrease in the pressure that depresses downwards the periphery of the wafer 12. In addition, the edge-depressing member 19 can effectively depress the periphery of the wafer 12, because the edge-depressing member 19 is arranged at the boundary 12*c* between the flat part 12*a* and edge part 12*b* of the wafer 12. Thus, the polishing rate can be maintained and non-uniform polishing can be prevented at the periphery of the wafer 12, and the controllability of the pressure applied by the edge-depressing member 19 can be increased.

In the present embodiment, the retainer ring 16 includes two members, i.e., fixed retainer ring 20 and released retainer ring 21. During the polishing process, the released retainer ring 21 can be held substantially integrally with the wafer 12, to prevent positional deviation of the wafer 12 from the released retainer ring 21. This can achieve stable polishing of the wafer 12 even at the periphery thereof.

Figure 5:
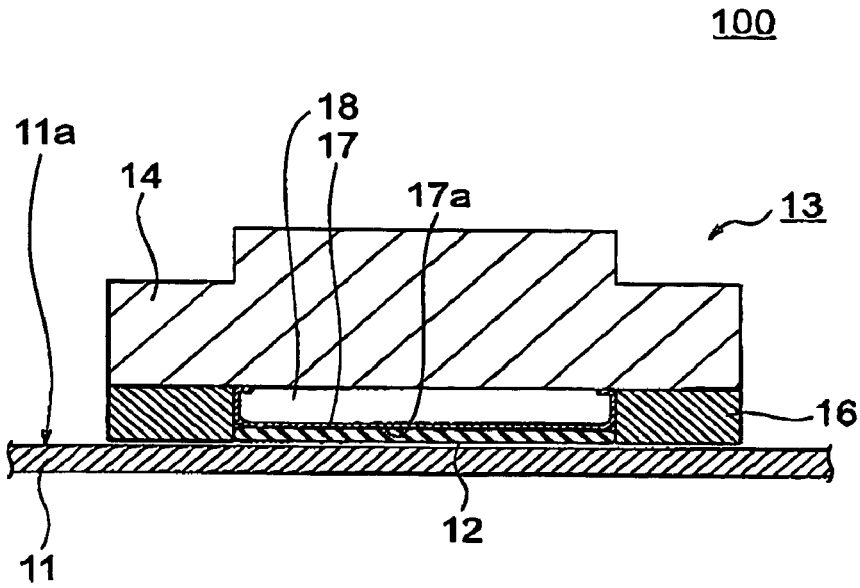
FIG. 5 is a sectional view depicting the configuration of a conventional polishing apparatus.
Figure 6:
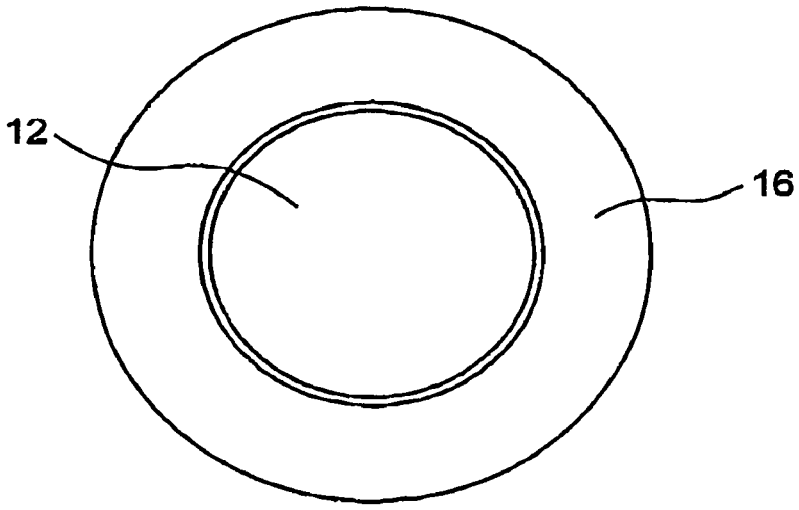
FIG. 6 is a top plan view illustrating the positional relationship that the retainer ring and the wafer have in the conventional polishing apparatus.
Figure 7:
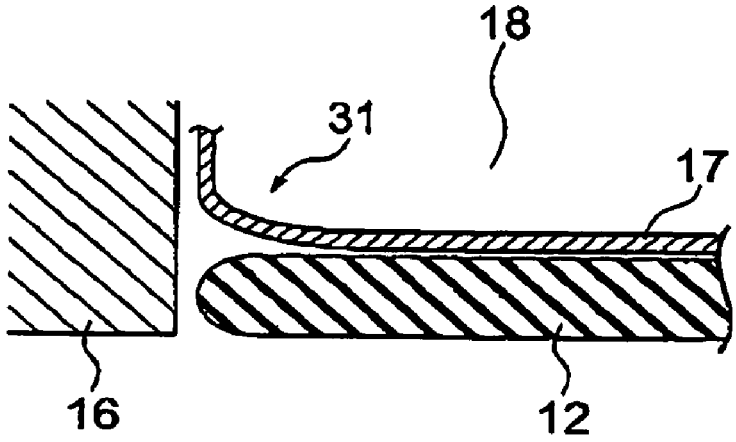
FIG. 7 is a sectional view depicting a problem encountered with the conventional polishing apparatus.

In order to assure the advantages of the present invention, wafers 12 were polished by using both the conventional polishing apparatus 100 shown in FIG. 5 and the polishing apparatus 10 according to the above embodiment. In the conventional polishing apparatus 100, an edge-depressing member 19 of the type incorporated in the polishing apparatus 10 of the above embodiment was arranged at the position indicated by number 32 in FIG. 4, with the center of the edge-depressing member 19 being positioned at distance X3 of 15 mm apart from the periphery of the wafer 12.

In the polishing apparatus 10 according to the embodiment, the polishing rate was increased within the range of the wafer 12, which extends for distance X3 of 15 mm from the periphery toward the center of the wafer 12, and in addition thereto, the controllability of polishing significantly increased. The range of variation in the polished surface of the wafer 12 was reduced down to ±5% by using the polishing apparatus 10 according to the embodiment, whereas the range of variation in the polished surface of the wafer 12 remained at ±10% in the conventional polishing apparatus 100. As evident from these results, the polishing apparatus 10 of the present embodiment can efficiently enhance the within-wafer uniformity of the polished wafer 12.

The released retainer ring 21 need not be of a ring shape, so long as the released retainer ring 21 has an outer edge that can be retained by the fixed retainer ring 20 and an inner edge that can retain the wafer 12. Nevertheless, the released retainer ring 21 can be best retained substantially integrally with the wafer 12 if it is of a ring shape. Further, the released retainer ring 21 may be composed of a plurality of members. The embodiment described above is a polishing apparatus designed for use in the CPM process for polishing oxide films. Nonetheless, the present invention can be applied to a variety of types of polishing apparatus for use in other CPM processes, such as a process for polishing metal films.

While the invention has been particularly shown and described with reference to exemplary embodiment and modifications thereof, the invention is not limited to these embodiment and modifications. It will be understood by those of ordinary skill in the art that various changes in form and details may be made therein without departing from the spirit and scope of the present invention as defined in the claims.

What is claimed is:

1. A polishing apparatus comprising:

a polishing pad configured to polish a wafer;

a polishing head configured to hold the wafer, said polishing head comprising:

a retainer ring for retaining the wafer in an in-plane direction of the wafer, said retainer ring comprising:

a first member depressed toward said polishing pad by a head body, said first member having a substantially ring shape and an inner diameter and thickness respectively greater than an outer diameter and thickness of the wafer; and a second member interposed between an inner edge of said first member and a periphery of said wafer to retain said periphery of said wafer in the in-plane direction of the wafer, said second member having a thickness substantially equal to the thickness of the wafer;

a membrane sheet for depressing the wafer and said second member toward said polishing pad; and said head body supporting thereon said retainer ring and said membrane sheet; and an edge-depressing ring member having a diameter less than a diameter of the second member disposed within the head body and directly above the periphery of the wafer, wherein the edge-depressing member depresses only a portion of the membrane sheet and only the periphery of the wafer.

2. The polishing apparatus according to claim 1, wherein said first member and said second member are formed as separate bodies.

3. The polishing apparatus according to claim 2, wherein said second member is of a substantially ring shape.

4. The polishing apparatus according to claim 2, wherein said second member has a substantially ring shape, and wherein said second member comprises a plurality of parts that constitute a portion of said ring shape.

5. The polishing apparatus according to claim 1, wherein said edge-depressing member is disposed on said membrane sheet.

6. The polishing apparatus according to claim 1, wherein said edge-depressing member has a substantially tubular ring shape, wherein an internal periphery of said substantially tubular ring shape communicates with an air supply that supplies high-pressure air to adjust a pressure of said high-pressure air, and wherein said pressure of said high-pressure air depresses said edge-depressing member to exert pressure on said periphery of said wafer.

7. The polishing apparatus according to claim 1, wherein air pressure is exerted on said edge-depressing member such that said edge-depressing member exerts pressure on said periphery of said wafer.

8. The polishing apparatus according to claim 1, wherein a pressure is exerted on said edge-depressing member at said periphery of said wafer, said pressure emanating from a plurality of air supply units.

9. The polishing apparatus according to claim 1, wherein said edge-depressing member is arranged at a boundary between a flat part of said wafer and an edge part of said wafer.

10. The polishing apparatus according to claim 1, wherein said edge-depressing member exerts a load onto said periphery of said wafer, said load adjusting a force depressing downwards onto said periphery of said wafer.

11. The polishing apparatus according to claim 8, wherein said edge-depressing member exerts a load onto said periphery of said wafer, said load adjusting said plurality of pressures emanating from a plurality of air supply units such that a force depresses downwards onto said periphery of said wafer.

12. The polishing apparatus according to claim 1, wherein said polishing pad further comprises a polishing surface having an axis around which said polishing pad rotates, wherein said membrane sheet further comprises a depressing surface at a bottom of said membrane sheet, said depressing surface being flat and having a substantially circular shape, said depressing surface having a surface that is greater than a surface of said wafer, said depressing surface having a periphery disposed outside of said periphery of said wafer, and wherein said second member is interposed between said polishing surface and said depressing surface of said membrane sheet.

13. The polishing apparatus according to claim 1, wherein an outer periphery of said second member contacts an inner periphery of said first member, and wherein an inner periphery of said second member contacts said periphery of said wafer.

14. The polishing apparatus according to claim 1, wherein said first member and said second member comprise one of poly-phenylene sulfide and poly-ether-ether-ketone.

15. A method of polishing a wafer, comprising:

providing a polishing head configured to hold the wafer, said polishing head including a retainer ring, a membrane sheet, and a head body, said retainer ring for retaining the wafer in an in-plane direction of the wafer, said retainer ring including a first member and a second member, said first member having a substantially ring shape and an inner diameter and thickness respectively greater than an outer diameter and thickness of the wafer, said second member being interposed between an inner edge of said first member and a periphery of said wafer to retain said periphery of said wafer in the in-plane direction of the wafer, said second member having a thickness substantially equal to the thickness of the wafer, said membrane sheet for depressing the wafer and said second member toward a polishing pad, said head body supporting thereon said retainer ring and said membrane sheet;

mechanically depressing the head body of the polishing head with a first load onto the polishing pad, the first member being depressed toward the polishing pad by the head body;

driving a first air supply unit to apply a second load onto said wafer and a top surface of a released retainer ring, said second load being smaller than said first load, said second load depressing the membrane sheet toward an entire surface of said wafer and toward a part of said released retainer ring that extends from an inner periphery of said released retainer ring; and providing an edge-depressing ring member having a diameter less than a diameter of the second member disposed within the head body and directly above the periphery of the wafer, said edge-depressing member depressing only a portion of the membrane sheet and only the periphery of the wafer to exert a third load onto the portion of the membrane sheet and the periphery of said wafer and depressing said membrane sheet onto substantially an entirety of said top surface of said released retainer ring, said third load adjusting a force depressing downwards onto said vicinity of said periphery of said wafer, said third load smaller than said first load.

16. The method according to claim 15, further comprising:

rotating said polishing pad around an axis of a polishing surface of said polishing pad, said rotating said polishing pad;

supplying a silica-based slurry onto a center of said polishing surface; and spreading said silica-based slurry over said polishing surface in a radial direction from said center of said polishing surface until an entirety of said polishing surface is covered by said silica-based slurry.

17. The method according to claim 15, further comprising:

attracting said wafer by suction in a facedown posture toward a bottom of said polishing head to move said wafer downwards to said polishing pad; and releasing said wafer in a released retainer ring.

18. The method according to claim 15, further comprising:

rotating said polishing head around an axis of said polishing head; and moving said polishing head in alternating radial directions of said polishing pad within a radius of said polishing pad.

19. The method according to claim 15, further comprising:

conducting a chemical mechanical polishing (CMP) process on a main surface of said wafer; and transporting said wafer to a washing apparatus after said conducting said CMP for a washing of said wafer.

20. The method according to claim 15, wherein said edge-depressing member is arranged at a boundary between a flat part and an edge part of said wafer.

* * * * *